US009130287B2

(12) United States Patent
Tai et al.

(10) Patent No.: US 9,130,287 B2
(45) Date of Patent: Sep. 8, 2015

(54) POWER CONNECTOR ASSEMBLY

(71) Applicant: ALLTOP ELECTRONICS (SUZHOU) LTD., Taicang, JiangSu Province (CN)

(72) Inventors: Hung-Chi Tai, Jhonghe (TW); Yung-Chih Hung, Jhonghe (TW); Chieh-Yu Cheng, Jhonghe (TW)

(73) Assignee: ALLTOP ELECTRONICS (SUZHOU) LTD., Taicang, JiangSu Province (CN)

( * ) Notice: Subject to any disclaimer, the term of this patent is extended or adjusted under 35 U.S.C. 154(b) by 78 days.

(21) Appl. No.: 13/743,022

(22) Filed: Jan. 16, 2013

(65) Prior Publication Data

US 2014/0120784 A1 May 1, 2014

(30) Foreign Application Priority Data

Oct. 30, 2012 (CN) ..... 2012 1 0423214

(51) Int. Cl.

| | |
|---|---|
| ***H01R 13/11*** | (2006.01) |
| *H01R 4/18* | (2006.01) |
| *H01R 13/645* | (2006.01) |
| *H01R 25/00* | (2006.01) |

(52) U.S. Cl.

CPC ..... *H01R 13/112* (2013.01); *H01R 13/113* (2013.01); *H01R 4/185* (2013.01); *H01R 13/6456* (2013.01); *H01R 25/003* (2013.01)

(58) Field of Classification Search

USPC ..... 439/856, 857, 502, 907

See application file for complete search history.

(56) References Cited

U.S. PATENT DOCUMENTS

| | | | | | |
|---|---|---|---|---|---|
| 3,808,578 | A * | 4/1974 | Hansen | ..... | 439/595 |
| 4,684,191 | A * | 8/1987 | Feher et al. | ..... | 439/246 |
| 4,845,589 | A * | 7/1989 | Weidler et al. | ..... | 361/614 |
| 4,932,906 | A * | 6/1990 | Kaley et al. | ..... | 439/857 |
| 5,759,055 | A * | 6/1998 | Colantuano et al. | ..... | 439/287 |
| 6,280,216 | B1 * | 8/2001 | Bernier et al. | ..... | 439/251 |
| 7,004,787 | B2 * | 2/2006 | Milan | ..... | 439/502 |
| 8,182,299 | B2 * | 5/2012 | Schrader | ..... | 439/857 |

* cited by examiner

*Primary Examiner* — Hien Vu

(74) *Attorney, Agent, or Firm* — Sughrue Mion, PLLC

(57) ABSTRACT

A power connector includes an insulative housing, at least a pair of power contacts assembled to the at least one contact-receiving passage. The pair of power contacts are arranged oppositely along an up-to-down direction and cooperating with each other. Each of the at least a pair of power contacts includes a cable termination portion, a contacting portion and an intermediate portion connecting the cable termination portion and the contacting portion. One lateral edge of the intermediate portion is a first latching portion, and the other lateral edge of the intermediate portion is a second latching portion. Thus, when the pair of power contacts are assembled together, the first latching portion of one power contact cooperates with the second latching portion of the other power contact, while the second latching portion of the one power contacts cooperates with the first latching portion of the other power contact to form a hollow frame therebetween along an up-to-down direction.

12 Claims, 10 Drawing Sheets

POWER CONNECTOR ASSEMBLY

BACKGROUND OF THE INVENTION

1. Field of the Invention

The present invention relates to a power connector and a power connector assembly, more particularly to a power connector and a power connector assembly connected with a cable.

2. Description of Related Art

A conventional electrical connector usually comprises an insulative housing and a plurality of conductive contacts received in the insulative housing. When an upper contact and a lower contact are assembled to a same contact-receiving passage of the insulative housing, there is no restriction structures between the pair of contacts for positioning the contacts relative to each other, further, there is no positioning structures in the insulative housing to restrict the contacts, thus, the contacts are prone to being escaped from the insulative housing. Thus, the electrical connection between the electrical connector and a complementary connector is influenced.

Hence, it is necessary to improve the conventional power connector to address problems mentioned above.

BRIEF SUMMARY OF THE INVENTION

Accordingly, an object of the present invention is to provide a power connector which has more stable structure and more stable reliability for mating with a complementary connector.

Accordingly, another object of the present invention is to provide a power connector assembly comprising the power connector addressed above.

In order to achieve the above-mentioned object, a power connector in accordance with the present invention comprises an insulative housing comprising at least one contact-receiving passage extending along a front-to-back direction, at least a pair of power contacts assembled to the at least one contact-receiving passage. The pair of power contacts are arranged oppositely along an up-to-down direction and cooperating with each other. Each of the at least a pair of power contacts comprises a cable termination portion, a contacting portion and an intermediate portion connecting the cable termination portion and the contacting portion. One lateral edge of the intermediate portion is a first latching portion, and the other lateral of the intermediate portion is a second latching portion, thus, when the pair of power contacts are assembled together, the first latching portion of one power contact cooperates with the second latching portion of the other power contact, while the second latching portion of the one power contacts cooperates with the first latching portion of the other power contact to form a hollow frame therebetween along an up-to-down direction.

The foregoing has outlined rather broadly the features and technical advantages of the present invention in order that the detailed description of the invention that follows may be better understood. Additional features and advantages of the invention will be described hereinafter, which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENTS

Figure 1:
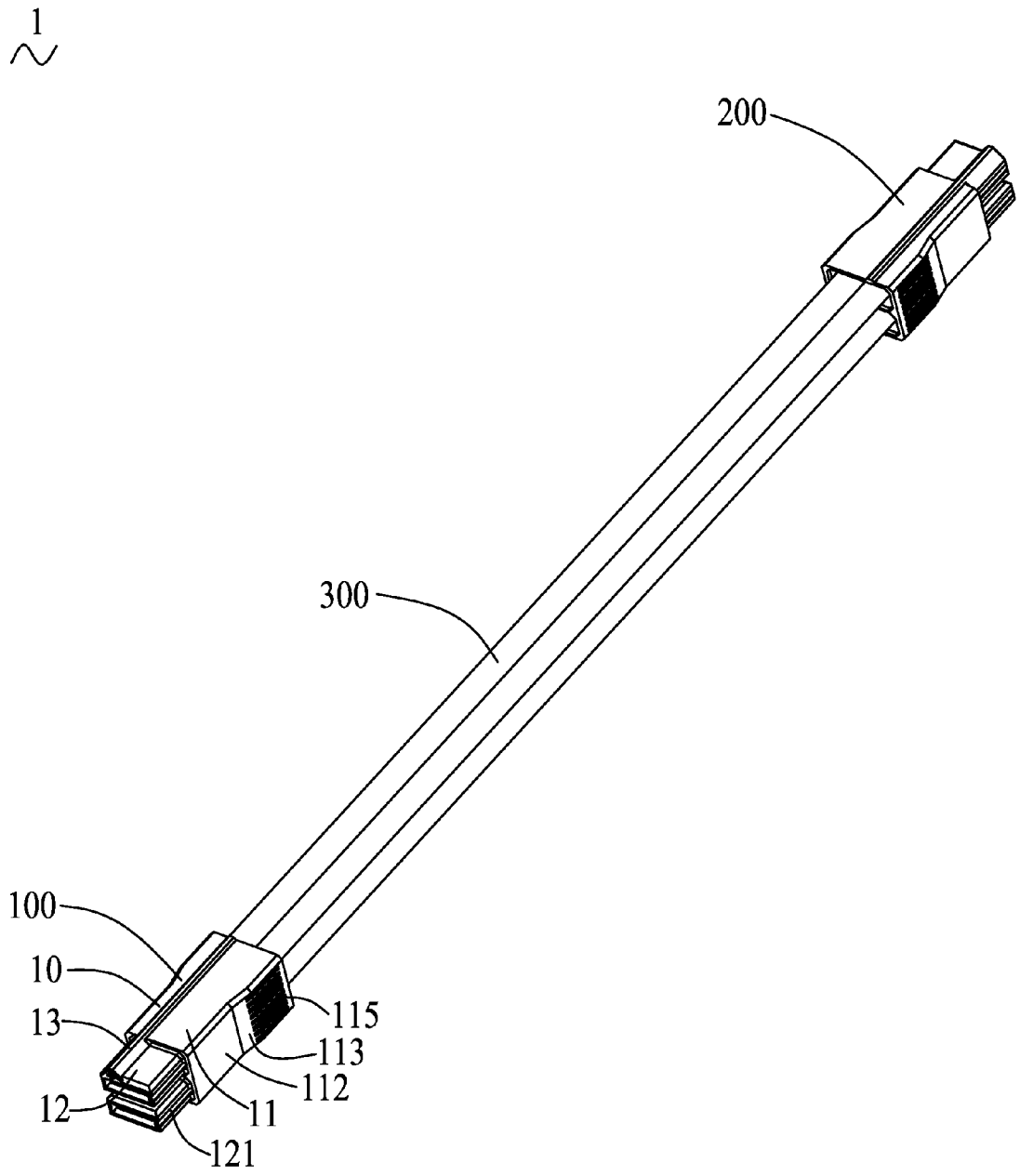
FIG. 1 is an assembled, perspective view of a power connector assembly in accordance with the present invention.

In the following description, numerous specific details are set forth to provide a thorough understanding of the present invention. However, it will be obvious to those skilled in the art that the present invention may be practiced without such specific details. In other instances, well-known circuits have been shown in block diagram form in order not to obscure the present invention in unnecessary detail. For the most part, details concerning timing considerations and the like have been omitted inasmuch as such details are not necessary to obtain a complete understanding of the present invention and are within the skills of persons of ordinary skill in the relevant art.

Reference will be made to the drawing figures to describe the present invention in detail, wherein depicted elements are not necessarily shown to scale and wherein like or similar elements are designated by same or similar reference numeral through the several views and same or similar terminology.

Please refer to FIG. 1, a power connector assembly 1 in accordance with the present invention comprises a first power connector 100, a second power connector 200, and a cable 300 connecting the first power connector 100 with the second power connector 200. In the preferred embodiment of the present invention, the first power connector 100 has the same structure as that of the second power connector 200. Hence, only the first power connector 100 is taken as an example to illustrate the structure thereof, and the structure of the second power connector 200 is omitted hereinafter.

Figure 2:
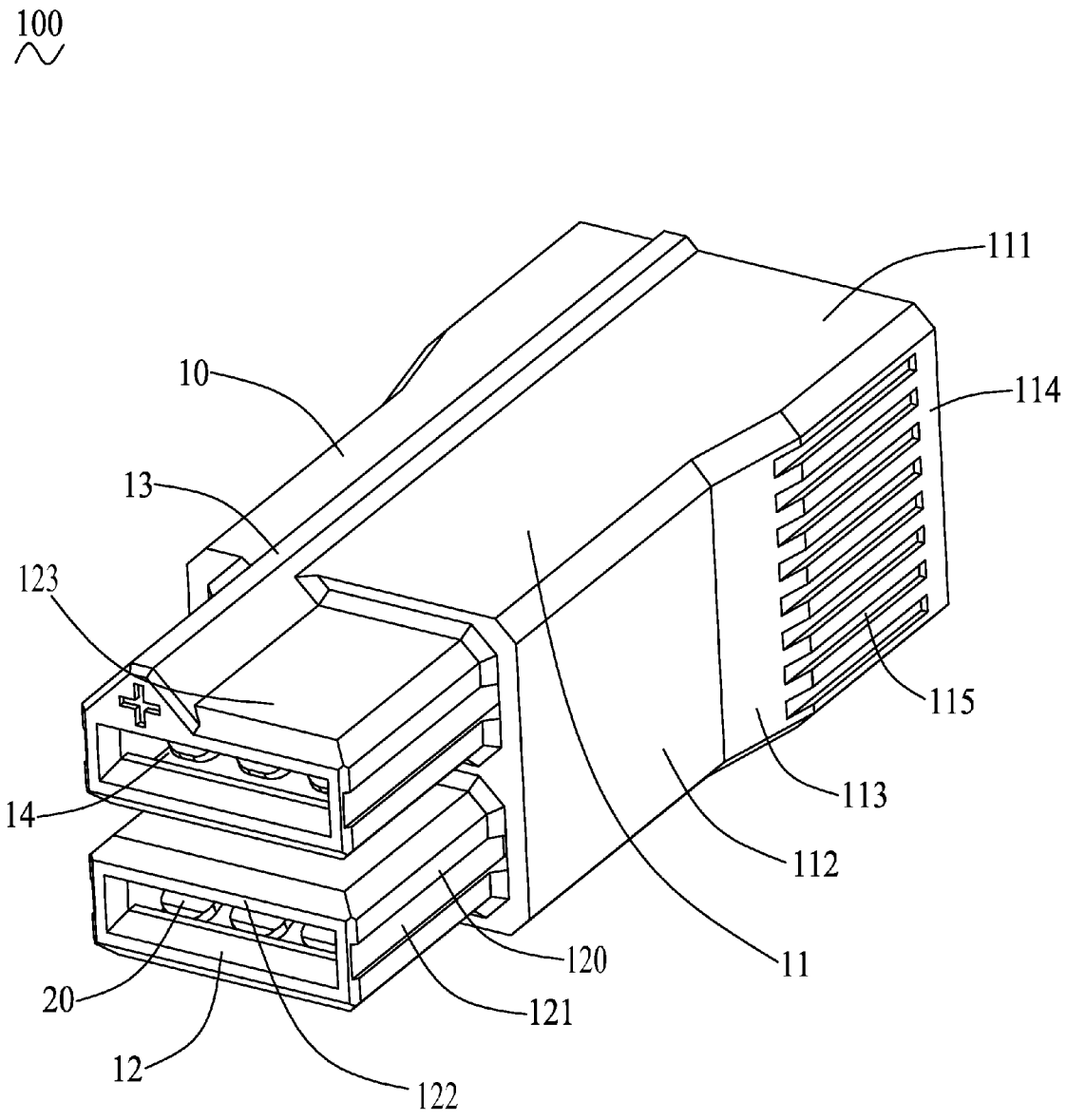
FIG. 2 is an assembled, perspective view of a first power connector shown in FIG. 1.
Figure 3:
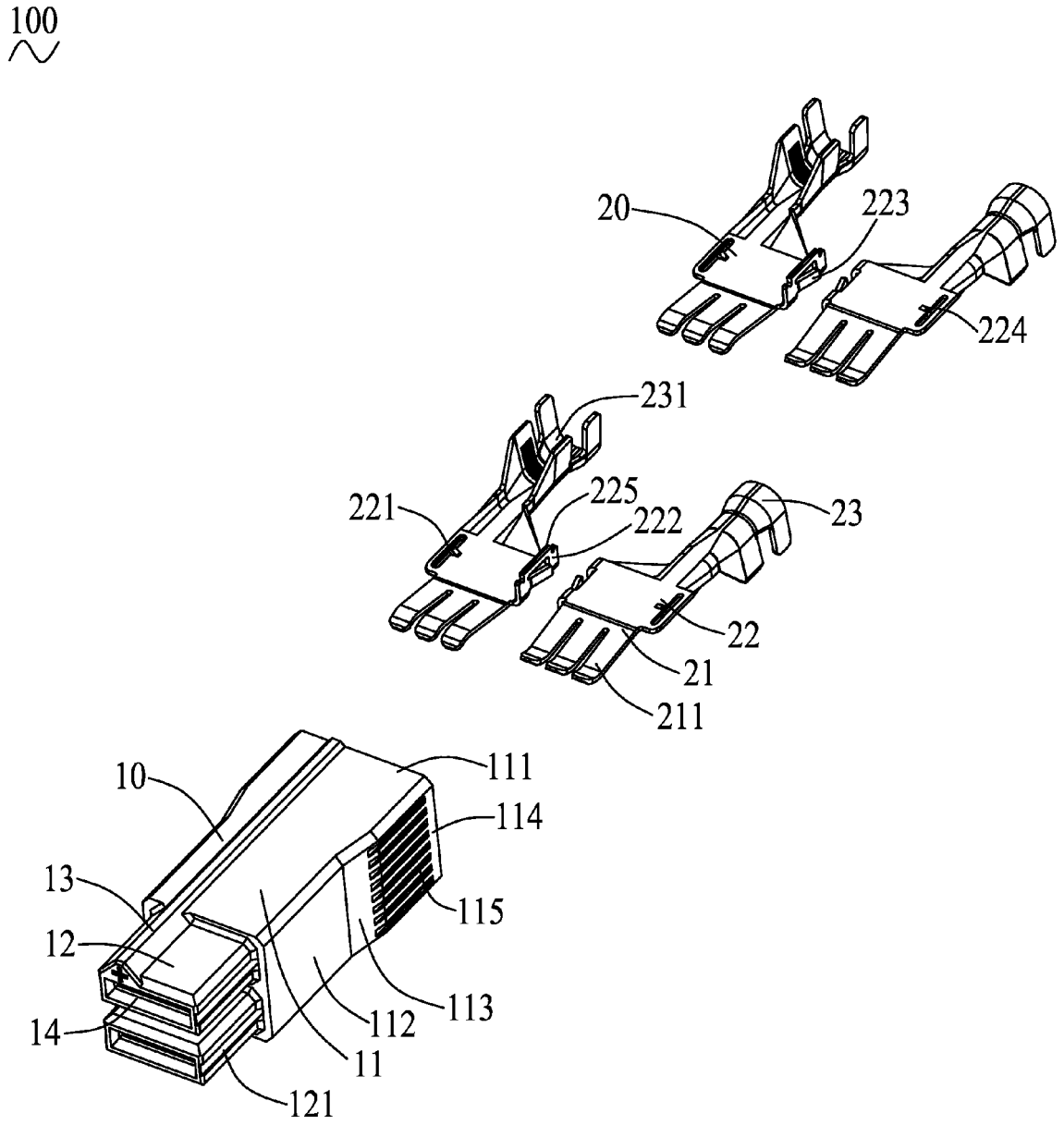
FIG. 3 is an exploded, perspective view of the first power connector of FIG. 2.

Please refer to FIGS. 2-3, the first power connector 100 comprises an insulative housing 10, and a plurality of power contacts 20 accommodated in the insulative housing 10.

Figure 4:
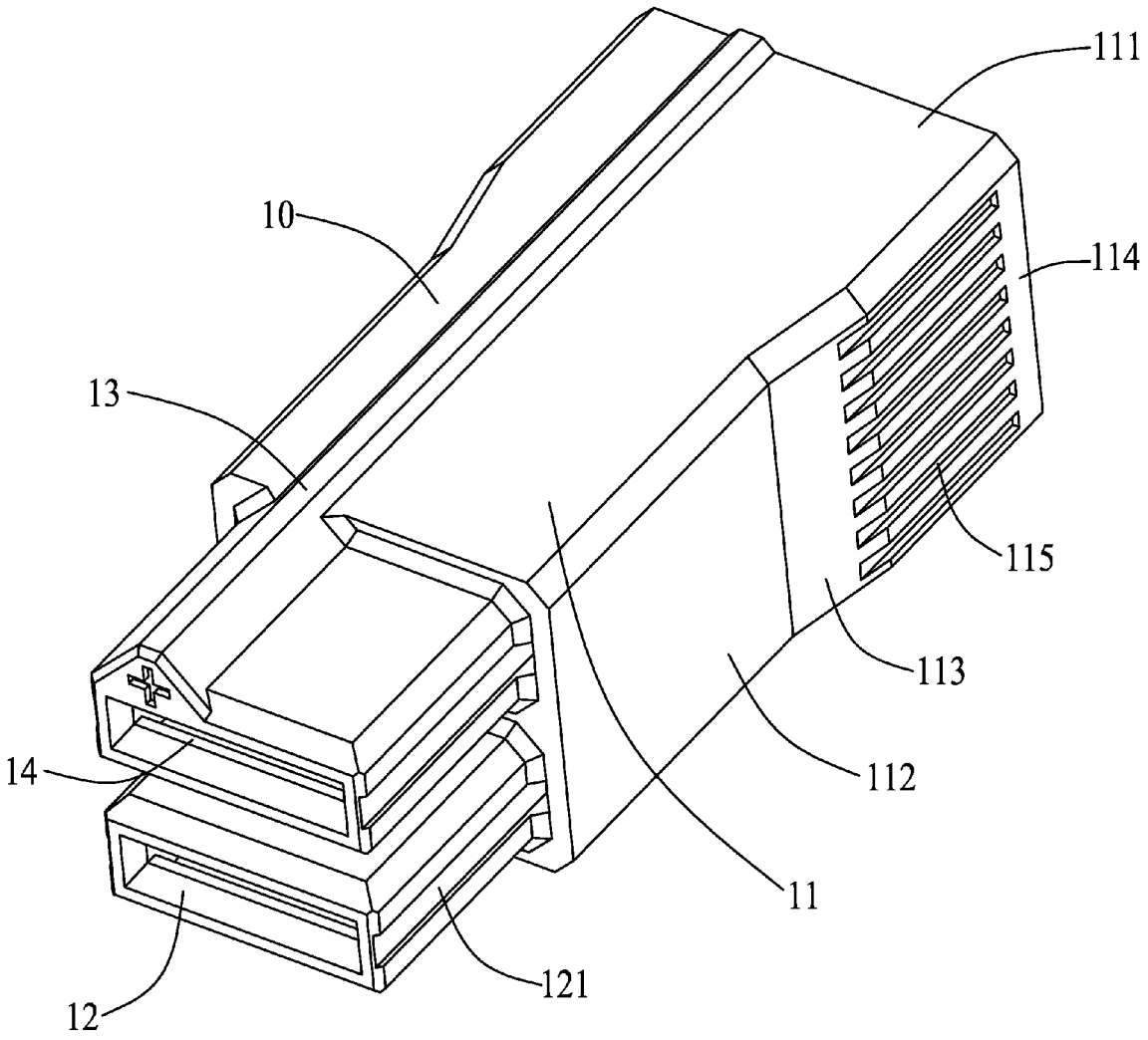
FIG. 4 is an enlarged view of an insulative housing shown in FIG. 3.
Figure 5:
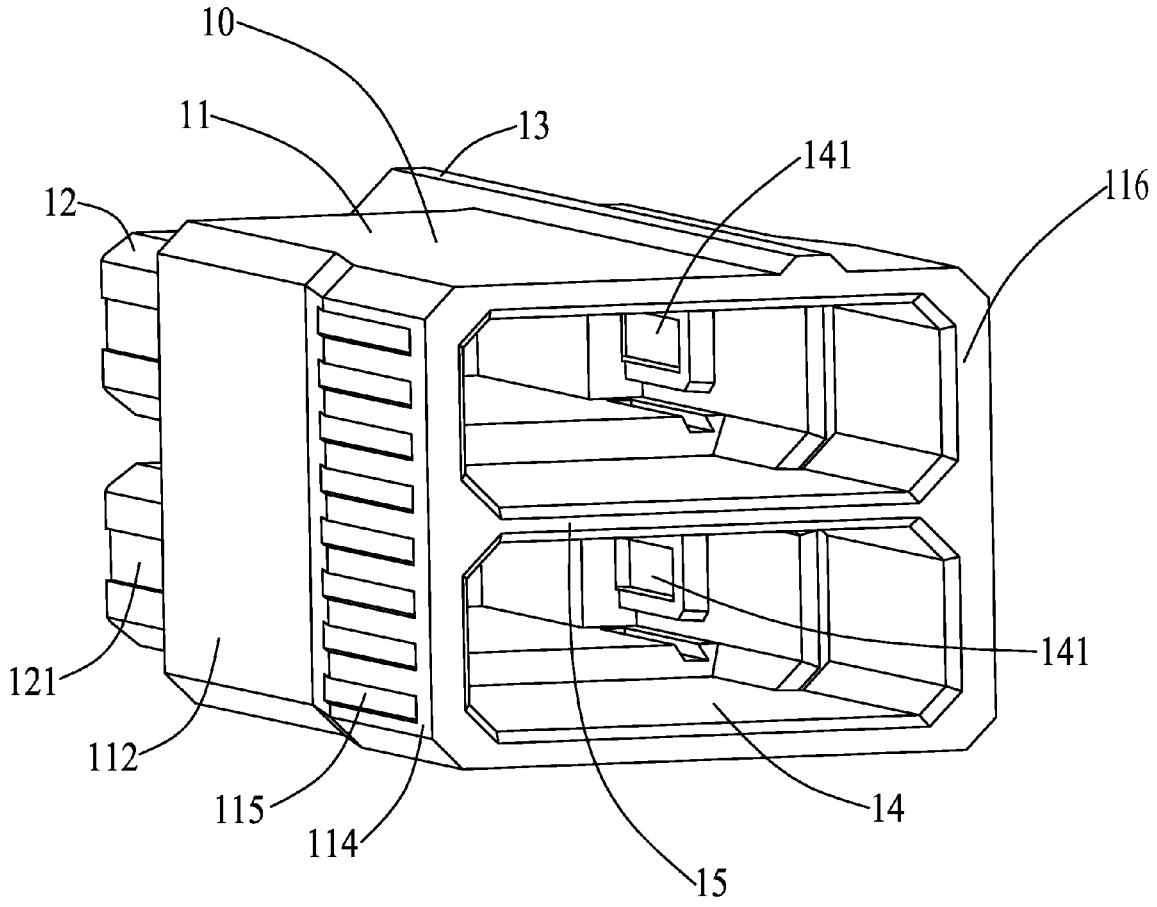
FIG. 5 is a view similar to FIG. 4, but from a different aspect.

Please refer to FIGS. 4-5 in conjunction with FIG. 3, the insulative housing 10 comprises a main body 11 and a pair of mating ports 12 extending forwardly from one end of the main body 11. The pair of mating ports 12 are aligned with each other along a thickness/up-to-down direction of the insulative housing 10 and spaced from each other. Each mating port 12 defines a recess 121 in at least one sidewall 120 thereof for cooperating with a complementary connector (not shown) and increasing stability of electrical connection. The recess 121 opens toward outside and extends rearward from a front surface 122 till the main body 11 of the insulative housing 10.

An anti-mismating means 13 protrudes outwardly from an outer surface of the mating port 12 and extends from the front surface 122 of the mating port 12 till a rear end 116 of the main body 11 along a mating direction of the first power connector 100. In the present embodiment, the anti-mismating means 13 is a trapeziform protrusion or a rib protruding outwardly from an upper surface 123 of the upper mating port 12 away from the other lower mating port 12 for anti-mismating.

The main body 11 comprises a base portion 111 and a junction portion 112 connecting with the mating ports 12. The base portion 111 has a larger width than that of the junction portion 112, thus an inclined connecting section 113 is formed between the base portion 111 and the junction portion 112. At least an anti-sliding slot 115 is defined on each lateral wall 114 of the base portion 111. In the preferred embodiment, each lateral wall 114 of the base portion 111 is defined with eight anti-sliding slots 115. The opposite lateral walls 114 connect with the inclined connecting sections 113 and are perpendicular to the outer surface/upper surface 123 from which the anti-mismating means 13 protrudes. Hence, when plugging/unplugging the first power connector 100, the anti-sliding slots 115 and the inclined connecting sections 113 could increase the friction force between hands and the insulative housing 10 for convenient plugging/unplugging.

The insulative housing 10 defines a pair of contact-receiving passages 14 for receiving the power contacts 20. A partition plate 15 is disposed between the pair of contact-receiving passages 14. The contact-receiving passage 14 corresponds to the mating port 12 and penetrates from the rear end 116 of the main body 11 to the front surface 122 of the mating port 12. Each contact-receiving passage 14 defines a restriction recess 141 in the middle section thereof.

Please refer to FIG. 3 in conjunction with FIG. 5, the power contacts 20 are grouped into two groups. Each group comprises two power contacts 20 arranged oppositely to each other along the up-to-down direction and cooperated with each other. Each power contact 20 comprises a cable termination portion 23, a contacting portion 21, and an intermediate portion 22 connecting the cable termination portion 23 with the contacting portion 21. The intermediate portion 22 is a flat piece and disposed with a first latching section 221 near to one lateral edge thereof, and an opposite second latching section 222 near to the other lateral edge thereof. The cable termination portion 23 is offset arranged to align with one lateral edge and away from the other lateral edge. The cable termination portion 23 forms a termination space 231 to crimp the cable 300. The contacting portion 21 forms three elastic contacting beams 211. After assembly, the contacting beams 211 of the contacting portions 21 of the pair of power contacts 20 are curved toward opposite directions to be away from each other. In the same group of power contacts 20, the first latching section 221 and the second latching section 222 of the upper power contact 20 respectively latch with the second latching section 222 and the first latching section 221 of the lower power contact 21 to form a hollow frame therebetween.

The second latching section 222 bends vertically from one lateral edge of the intermediate portion 22 and is punched with a cantilevered beam 223 bending outwardly therefrom. After the pair of power contacts 20 are assembled with each other, the cantilevered beams 223 are received in the restriction recesses 141 of the contact-receiving passage 14 for restricting the power contacts 20 in the insulative housing 10. The first latching section 221 is in the form of a positioning slit 224 extending mainly along the mating direction of the first power connector 100. A positioning slice 225 extends upwardly or downwardly additionally from the second latching section 222 to be located above or below the cantilevered beam 223. After the pair of power contacts 20 are assembled to each other, the positioning slices 225 are respectively inserted into the positioning slits 224 for achieving stable assembly.

The cooperation means between the first latching sections 221 and the second latching sections 222 of the pair of power contacts 20 can have different ways, detailed explanations will be given with referring to FIGS. 6-9.

Figure 6:
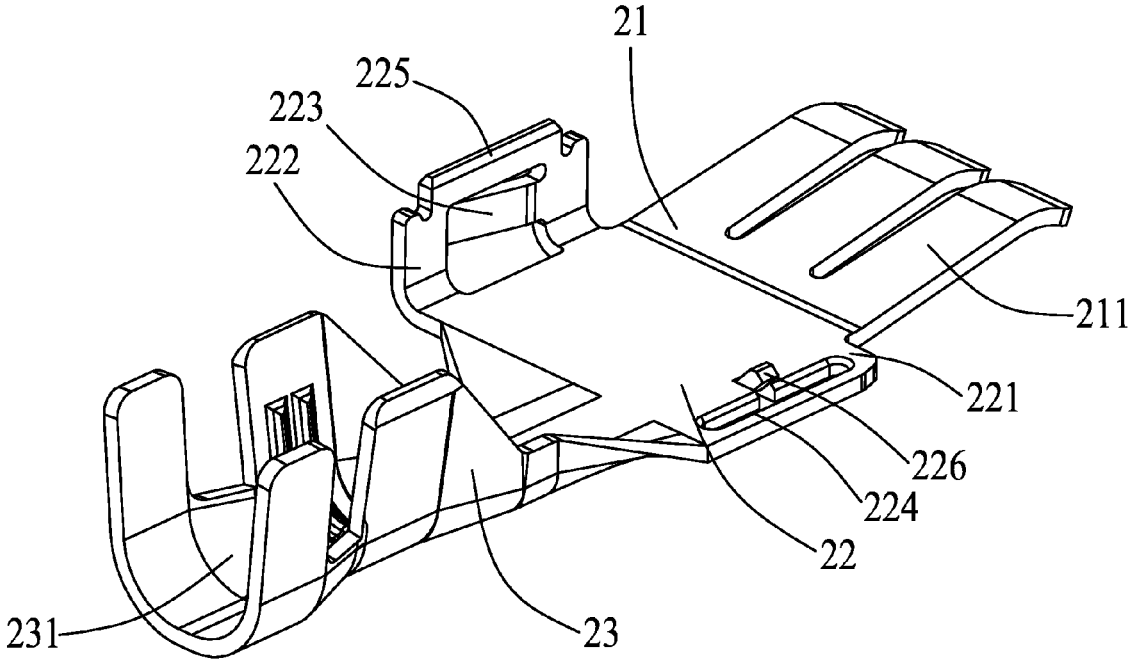
FIG. 6 is a perspective view of a power contact in accordance with a first embodiment.

Please refer to FIG. 6 in conjunction with FIG. 3, a first embodiment of the power contact 20 is illustrated. The first latching section 221 comprises a rib 226 bending inclined from an edge of the positioning slit 224 to abut against one side of the cantilevered beam 223 of the other power contact 20. Thus, the movement of the second latching section 222 of the other power contact 20 along an up-to-down direction and front-to-back direction in the positioning slit 224 could be restricted, thus enhancing the assembly stability.

Figure 7:
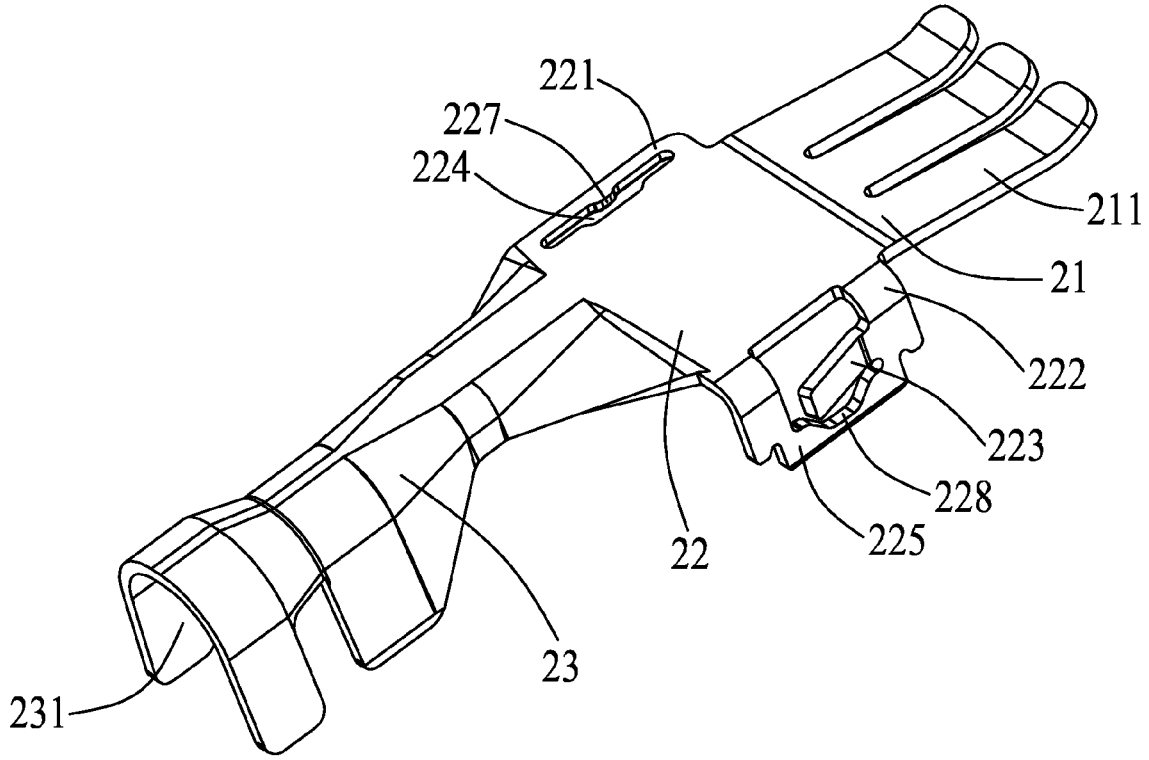
FIG. 7 is a perspective view of a power contact in accordance with a second embodiment.

Please refer to FIG. 7 in conjunction with FIG. 3, a second embodiment of the power contact 20 is illustrated. A protrusion 227 protrudes from a middle of one edge of the positioning slit 224 toward the other edge of the positioning slit 224 for guiding the positioning slice 225 to insert into the positioning slit 224 smoothly. Correspondingly, the positioning slice 225 defines a cutout 228 facing the cantilevered beam 223 to receive the protrusion 227 for restricting the movement of the second latching section 222 in the positioning slit 224 of the other power contact 20 along up-to-down and front-to-back directions.

Figure 8:
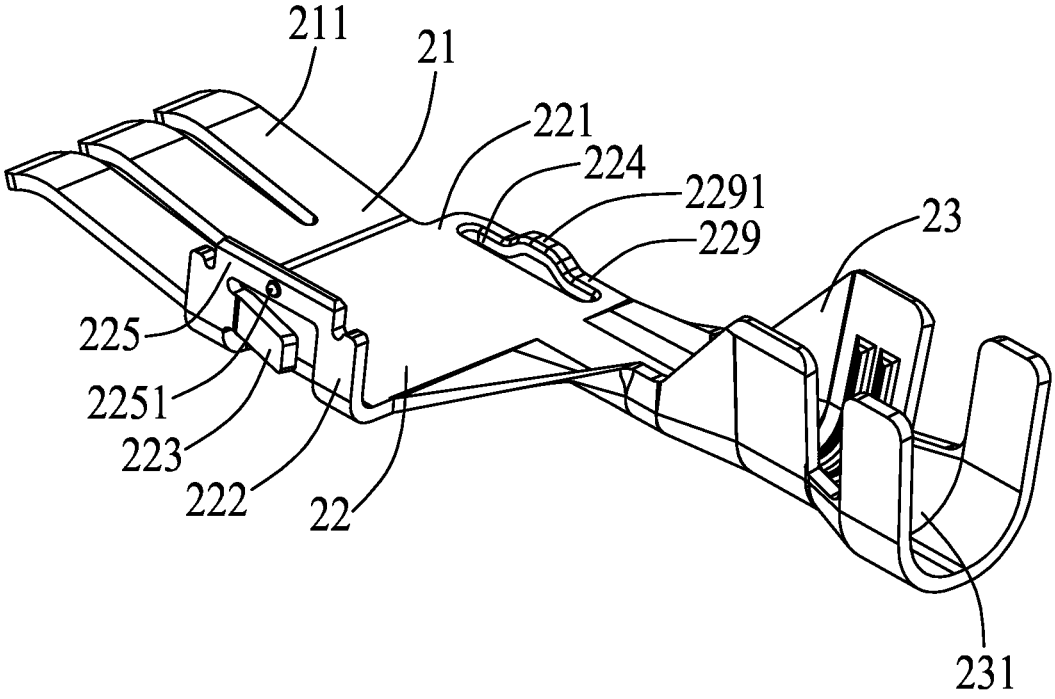
FIG. 8 is a perspective view of a power contact in accordance with a third embodiment.

Please refer to FIG. 8 in conjunction with FIG. 3, a third embodiment of the power contact 20 is illustrated. An outer edge of the positioning slit 224 of the first latching section 221 is curved along the up-to-down direction to be served as a restriction section 229 which has a curved edge 2291 in the center section thereof to form an arch-bridge shape. A protruding spot 2251 is formed on an outer side of the positioning slice 225 for being located below the curved edge 2291 of the restriction section 229 for restricting the movement of the positioning slice 225 along an up-to-down direction. Thus, the movement of the second latching section 222 in the positioning slit 224 along an up-to-down direction is also restricted.

Figure 9:
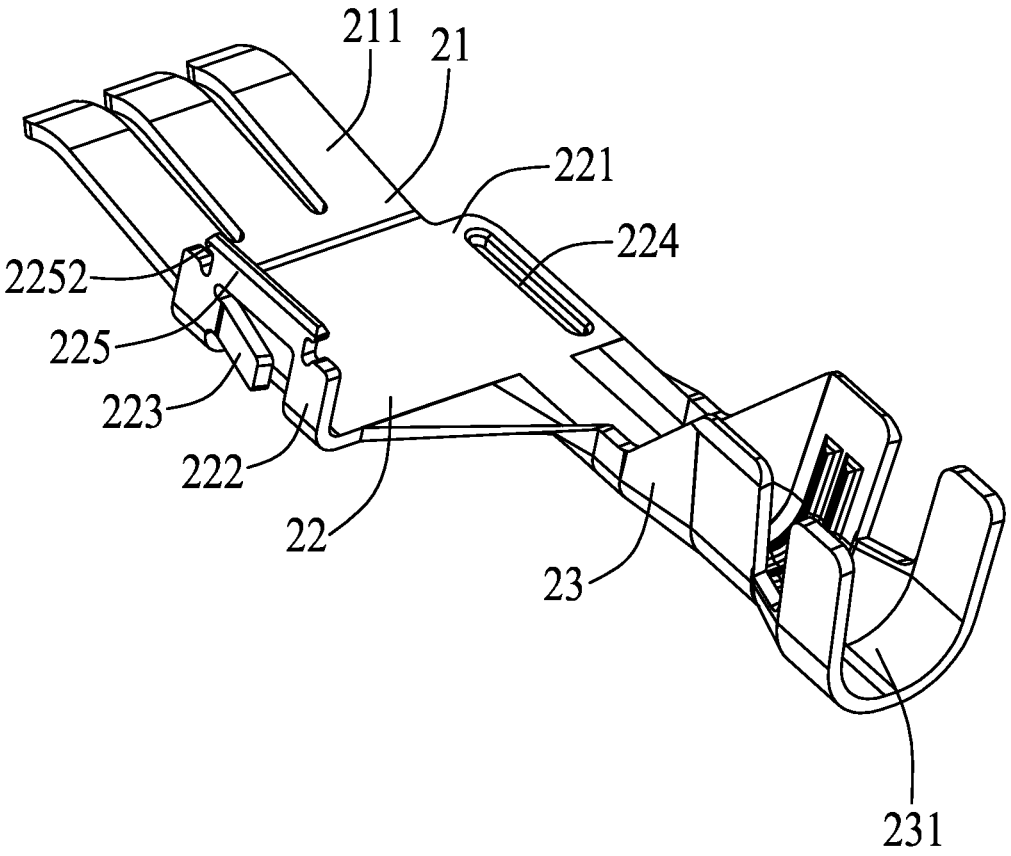
FIG. 9 is a perspective view of a power contact in accordance with a fourth embodiment.
Figure 10:
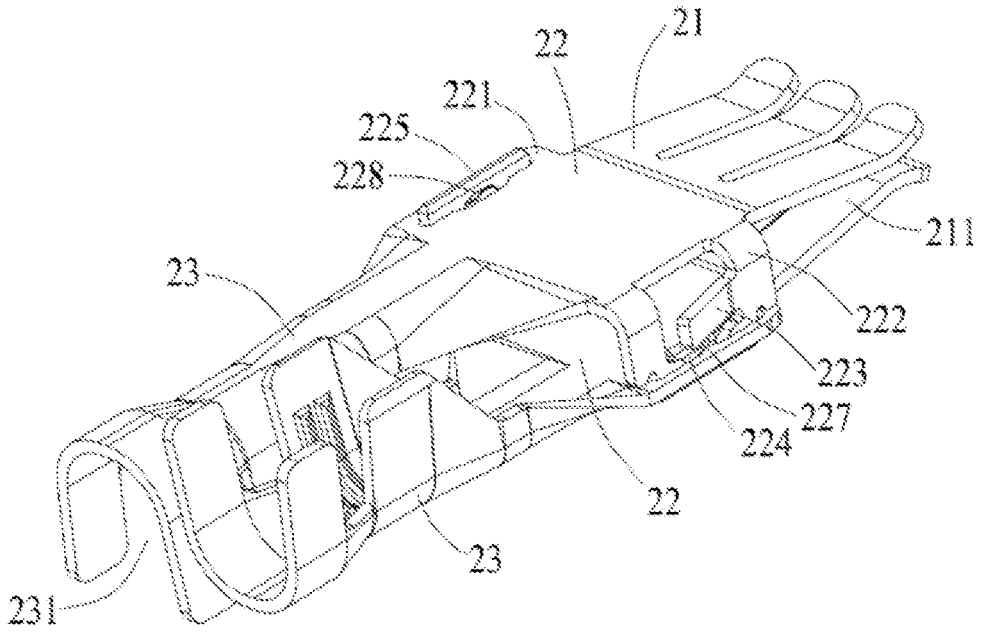
FIG. 10 is a perspective view of a pair of cooperated power contacts.

Please refer to FIG. 9 in conjunction with FIG. 3, a fourth embodiment of the power contact 20 is illustrated. The outer edge of the positioning slice 225 is lengthened outwardly along the mating direction of the first electrical connector 100, thus the length of the positioning slice 225 is longer than that of the positioning slit 224. The excessive sections beyond the positioning slit 224 form a pair of block sections 2252 to abut against the first latching section 221 near to the positioning slit 224 for preventing the positioning slice 225 from escaping from the positioning slit 224, thus restricting the up-to-down movement of the second latching section 222 in the positioning slit 224 of the other power contact 20.

In summary, the power connector assembly 1 in accordance with the present invention comprises the first and second power connector 100, 2000 with the same structure. On one hand, the anti-mismating means 13 arranged on the insulative housing 10 of the first and second power connectors 100, 200 prevents the first and second power connectors 100, 200 from mismating. On the other hand, the different cooperation means between the first and second latching sections 221, 222 of the first and second power connectors 100, 200 effectively restricts the relative movement of the pair of power contacts 20 along up-to-down direction, thus preventing the power contacts 20 from escaping from each other.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed. For example, the tongue portion is extended in its length or is arranged on a reverse side thereof opposite to the supporting side with other contacts but still holding the contacts with an arrangement indicated by the broad general meaning of the terms in which the appended claims are expressed.

We claim:

1. An electrical power connector, comprising:

an insulative housing comprising at least one contact-receiving passage extending along a front-to-back direction;

at least one pair of power contacts assembled to the at least one contact-receiving passage, and the pair of power contacts arranged oppositely along an up-to-down direction and cooperating with each other;

wherein each of the at least one pair of power contacts comprises a cable termination portion, a contacting portion and an intermediate portion connecting the cable termination portion and the contacting portion;

wherein one lateral edge of the intermediate portion is a first latching portion, and the other lateral edge of the intermediate portion is a second latching portion;

wherein when the pair of power contacts are assembled together, the first latching portion of one power contact cooperates with the second latching portion of the other power contact, while the second latching portion of the one power contacts cooperates with the first latching portion of the other power contact to thereby form a hollow frame therebetween along an up-to-down direction;

wherein the first latching portion defines a positioning slit therein along a mating direction of the power connector, and wherein the second latching portion bends vertically from the intermediate portion and forms a positioning slice at a free end thereof to be inserted into the positioning slit;

wherein the second latching portion forms a cantilevered beam bending outwardly therefrom and adjacent to the positioning slice, and wherein the at least one contact-receiving passage defines a restriction recess on inner side thereof to cooperate with the cantilevered beam.

2. The electrical power connector as claimed in claim 1, wherein the first latching portion forms a rib bending inclined from one edge of the positioning slit, and wherein the rib abuts against the cantilevered beam along the up-to-down direction.

3. The electrical power connector as claimed in claim 1, wherein the first latching portion forms a protrusion on one edge of the positioning slit toward the other edge of the positioning slit, and wherein the second latching portion defines a cutout recessed toward the positioning slice, the protrusion is received in the cutout after the pair of power contacts are assembled together.

4. The electrical power connector as claimed in claim 1, wherein one edge of the positioning slit of the first latching portion of one power contact is curved to form a restriction section which is in the form of a curved edge along an up-to-down direction, and wherein the positioning slice forms a protruding spot on outer side thereof to cooperate with the curved edge for restricting the movement of the power contacts along the up-to-down direction.

5. The electrical power connector as claimed in claim 1, wherein the positioning slice forms a pair of block sections to have a longer length than that of the positioning slit for restricting the movement of the power contacts along the up-to-down direction.

6. The electrical power connector as claimed in claim 1, wherein the insulative housing defines a pair of contact-receiving passages arranged along the up-to-down direction, and wherein the power contacts are grouped into two groups to be respectively received in the receiving spaces.

7. The electrical power connector as claimed in claim 1, wherein the insulative housing comprises a pair of mating ports arranged along the up-to-down direction and a common main body connecting with the pair of mating ports, and wherein each mating port is assembled with a pair of power contacts arranged oppositely.

8. An electrical power connector assembly, comprising:

a first power connector;

a second power connector; and a cable connecting the first power connector with the second power connector;

wherein each of the first power connector and the second power connector comprises:

an insulative housing comprising at least one contact-receiving passage extending along a front-to-back direction;

at least one pair of power contacts assembled to the at least one contact-receiving passage, and the pair of power contacts arranged oppositely along an up-to-down direction and cooperating with each other;

wherein each of the at least one pair of power contacts comprises a cable termination portion, a contacting portion and an intermediate portion connecting the cable termination portion and the contacting portion;

wherein one lateral edge of the intermediate portion is a first latching portion, and the other lateral edge of the intermediate portion is a second latching portion;

wherein when the pair of power contacts are assembled together, the first latching portion of one power contact cooperates with the second latching portion of the other power contact, while the second latching portion of the one power contacts cooperates with the first latching portion of the other power contact to thereby form a hollow frame therebetween along an up-to-down direction;

wherein the first latching portion defines a positioning slit therein along a mating direction of the power connector, and wherein the second latching portion bends vertically from the intermediate portion and forms a positioning slice at a free end thereof to be inserted into the positioning slit wherein the second latching portion forms a cantilevered beam bending outwardly therefrom and adjacent to the positioning slice and wherein the at least one contact-receiving passage defines a restriction recess on inner side thereof to cooperate with the cantilevered beam.

9. The electrical power connector as claimed in claim 8, wherein the first latching portion forms a rib bending inclined from one edge of the positioning slit, and wherein the rib abuts against the cantilevered beam along the up-to-down direction.

10. The electrical power connector as claimed in claim 8, wherein the first latching portion forms a protrusion on one edge of the positioning slit toward the other edge of the positioning slit, and wherein the second latching portion defines a cutout recessed toward the positioning slice, the protrusion is received in the cutout after the pair of power contacts are assembled together.

11. The electrical power connector assembly as claimed in claim 8, wherein one edge of the positioning slit of the first latching portion of one power contact is curved to form a restriction section which is in the form of a curved edge along an up-to-down direction, and wherein the positioning slice forms a protruding spot on outer side thereof to cooperate with the curved edge for restricting the movement of the power contacts along the up-to-down direction.

12. The electrical power connector as claimed in claim 8, wherein the positioning slice forms a pair of block sections to have a longer length than that of the positioning slit for restricting the movement of the power contacts along the up-to-down direction.

* * * * *